United States Patent [19]

McCandless

[11] Patent Number: 4,637,804

[45] Date of Patent: Jan. 20, 1987

[54] METHOD OF CONSTRUCTING AN ELECTRON GUN HAVING AN IMPROVED TRANSITION MEMBER AND PRODUCT THEREOF

[75] Inventor: Harry E. McCandless, Manor Township, Lancaster County, Pa.

[73] Assignee: RCA Corporation, Princeton, N.J.

[21] Appl. No.: 844,346

[22] Filed: Mar. 26, 1986

[51] Int. Cl.[4] ..... H01J 9/12

[52] U.S. Cl. ..... 445/36; 445/35; 228/170

[58] Field of Search ..... 445/35, 36; 228/191, 228/170; 29/423

[56] References Cited

U.S. PATENT DOCUMENTS

| | | | |
|---|---|---|---|
| 3,569,797 | 3/1969 | Simmons | 317/234 |
| 3,571,920 | 3/1971 | Berg | 29/588 |
| 4,331,740 | 5/1982 | Burns | 428/572 |
| 4,370,215 | 1/1983 | Frudd | 228/191 |

OTHER PUBLICATIONS

U.S. patent application Ser. No. 735,261, filed on May 17, 1985, by H. E. McCandless, titled Multibeam Electron Gun Having a Transition Member and Method for Assembling the Electron Gun.

U.S. patent application Ser. No. 769,970, filed on Aug. 27, 1985, by S. T. Opresko, titled Multibeam Electron Gun Having Means for Supporting a Screen Grid Electrode Relative to a Main Focusing Lens.

U.S. patent application Ser. No. 769,978, filed on Aug. 27, 1985, by A. K. Wright, titled Multibeam Electron Gun Having Means for Positioning a Screen Grid Electrode.

*Primary Examiner*—Nicholas P. Godici
*Assistant Examiner*—K. Rowan
*Attorney, Agent, or Firm*—Eugene M. Whitacre; Dennis H. Irlbeck; Vincent J. Coughlin, Jr.

[57] ABSTRACT

An electron gun comprises, as in prior guns, a plurality of metal gun elements, held in position from a common ceramic member. A novel transition member is brazed to the common ceramic member. The transition member has a contact portion and a removable frame portion. The transition member is a bimetal comprising two layers of metal bonded face-to-face along an interface extending therebetween. A first layer of metal has a melting point higher than that of a second layer of metal.

The novel transition member is provided with a V-notched weakened bridge region extending through the first layer of metal and terminating at the interface with the second layer of metal having the lower melting point. The frame portion of the transition member is removed from the contact portion at the V-notched bridge region when the transition member is brazed to the common ceramic member and the second layer of metal melts. The contact portion has a substantially smooth edge following removal of the frame portion.

2 Claims, 7 Drawing Figures

METHOD OF CONSTRUCTING AN ELECTRON GUN HAVING AN IMPROVED TRANSITION MEMBER AND PRODUCT THEREOF

BACKGROUND OF THE INVENTION

The present invention relates to an electron gun of ceramic-metal construction and, more particularly, to a method of constructing an electron gun having a novel bimetal transition member which is used in such a gun between a common ceramic member and at least one of the metal gun elements. The novel transition member is substantially free of sharp or rough edges. Consequently, the present electron gun has better electrical stability than prior electron guns of ceramic-metal construction that used prior transition members.

U.S. patent application, Ser. No. 735,261, filed on May 17, 1985 by H. E. McCandless and assigned to the assignee of the present invention, discloses an electron gun having a transition member brazed directly to a major surface of a common ceramic member. The metal gun elements are then welded to the transition member in order to prevent distortion of the gun elements during brazing. This procedure prevents cracking of the ceramic member. The transition member is formed from two layers of dissimilar metal bonded face-to-face to form a bimetal. The first layer is a relatively thick nickel-iron alloy layer and the second layer is a relatively thin layer of copper. The transition member includes an electrode contact portion and a removable frame portion connected to the electrode contact portion by a weakened bridge region. The weakened bridge region is formed by providing a pair of oppositely disposed and substantially aligned notches in the transition member. The notches are formed such that the top notch extends partially through the nickel-iron first layer. The corresponding lower notch extends completely through the copper second layer and into the nickel-iron first layer. The top and bottom notches are spaced apart but aligned to facilitate breaking the frame portion away from the electrode contact portion at the weakened bridge region after the transition member is brazed to the common ceramic member. A sharp, rough edge is produced at the weakened bridge region where the frame portion is broken away. This sharp, rough edge is undesirable because of the possibility of injury to manufacturing personnel assembling the electron gun and also because the irregular edge may promote electrical malfunctions, such as cold emission or arcing in the finished tube. Because of cost considerations, it is impractical to eliminate the sharp, rough edge by chemical or mechanical means. Accordingly, it is desirable to eliminate the irregular edge but without adding additional cost to the electron gun.

SUMMARY OF THE INVENTION

An electron gun comprises, as in prior guns, a plurality of metal gun elements, held in position from a common ceramic member. A novel transition member is brazed to the common ceramic member. The transition member has a contact portion and a removable frame portion. The transition member is a bimetal comprising two layers of metal bonded face-to-face along an interface extending therebetween. A first layer of metal has a melting point higher than that of a second layer of metal.

The novel transition member is provided with a V-notched weakened bridge region extending through the first layer of metal and terminating at the interface with the second layer of metal. The frame portion of the transition member is removed from the contact portion at the V-notched bridge region when the transition member is brazed to the common ceramic member. The contact portion has a substantially smooth edge following removal of the frame portion.

DETAILED DESCRIPTION OF THE PREFERRED EMBODIMENT

Figure 1:
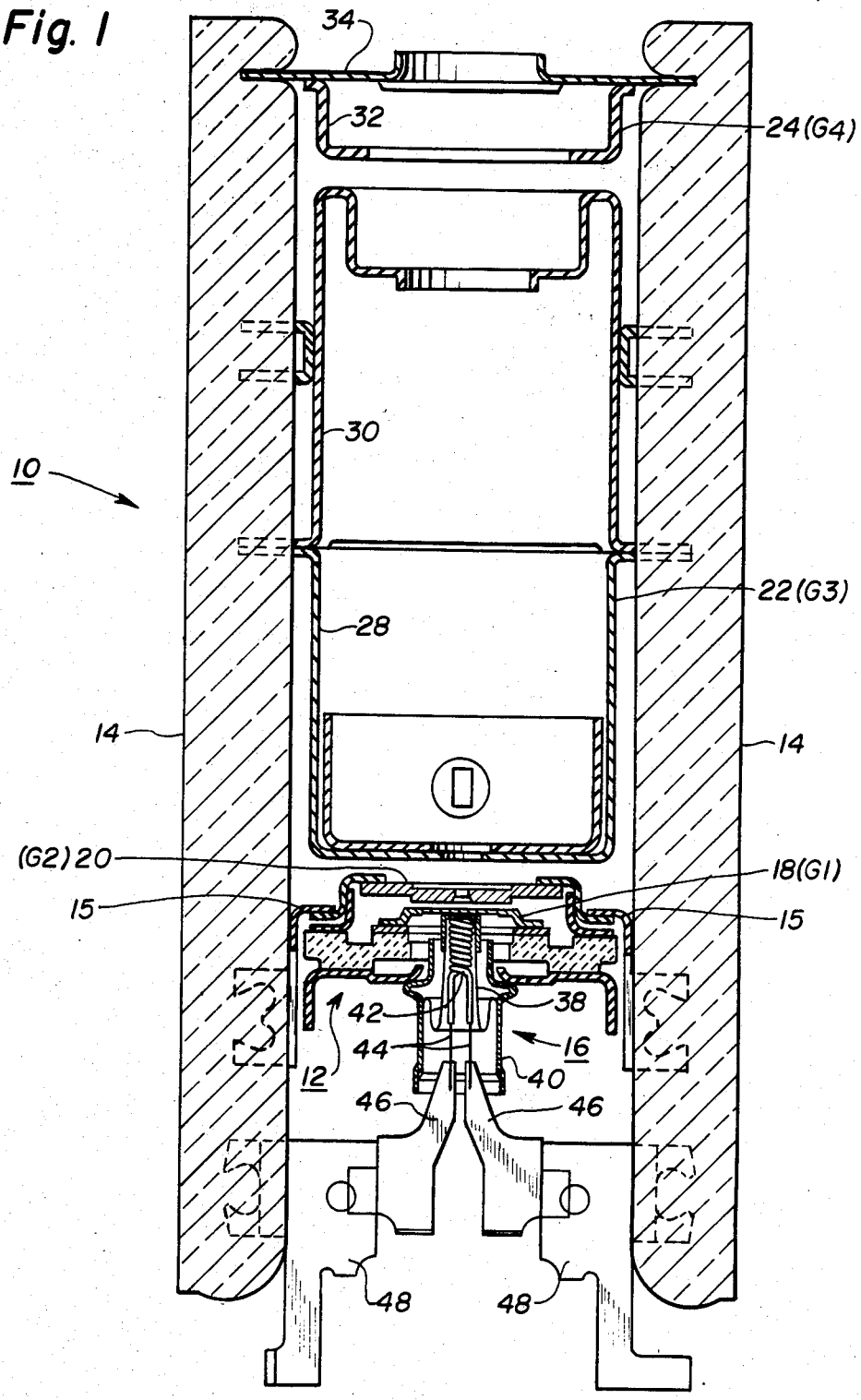
FIG. 1 is a partially cut-away, side elevational view of a preferred embodiment of the present electron gun.

As shown in FIG. 1, an improved electron gun 10 includes a modular beam-forming region (BFR) subassembly 12 secured to a pair of glass support rods 14, also called beads, by a plurality of metal bead support members 15. The modular BFR subassembly 12 includes a plurality of metal gun elements comprising three equally spaced inline cathode assemblies 16, one for each electron beam (only one of which is shown in the view of FIG. 1), a control grid (G1) electrode 18 and a screen grid (G2) electrode 20. Longitudinally spaced from the BFR subassembly 12 is a main focusing lens comprising a first focusing (G3) electrode 22 and a second focusing (G4) electrode 24.

The first focusing electrode 22 comprises a substantially rectangularly cup-shaped lower member 28 and a similarly shaped upper member 30 joined together at their open ends. The closed ends of the members 28 and 30 have three apertures therethrough, although only the center apertures are shown in FIG. 1. The apertures in the first focusing electrode 22 are aligned with the apertures in the control and screen grid electrodes 18 and 20. The second focusing electrode 24 comprises a rectangularly cup-shaped member 32 and an apertured plate member 34. Three inline apertures also are formed in the ends of the members 32 and 34.

Each of the cathode assemblies 16 comprises a substantially cylindrical cathode sleeve 38 closed at the forward end and having an electron emissive coating (not shown) thereon. The cathode sleeve 38 is supported at its open end within a cathode eyelet 40. A heater coil 42 is positioned within the sleeve 38 in order to indirectly heat the electron emissive coating. The heater coil 42 has a pair of legs 44 which are welded to heater straps 46 which, in turn, are welded to support studs 48 that are embedded in the glass support rods 14.

Figure 2:
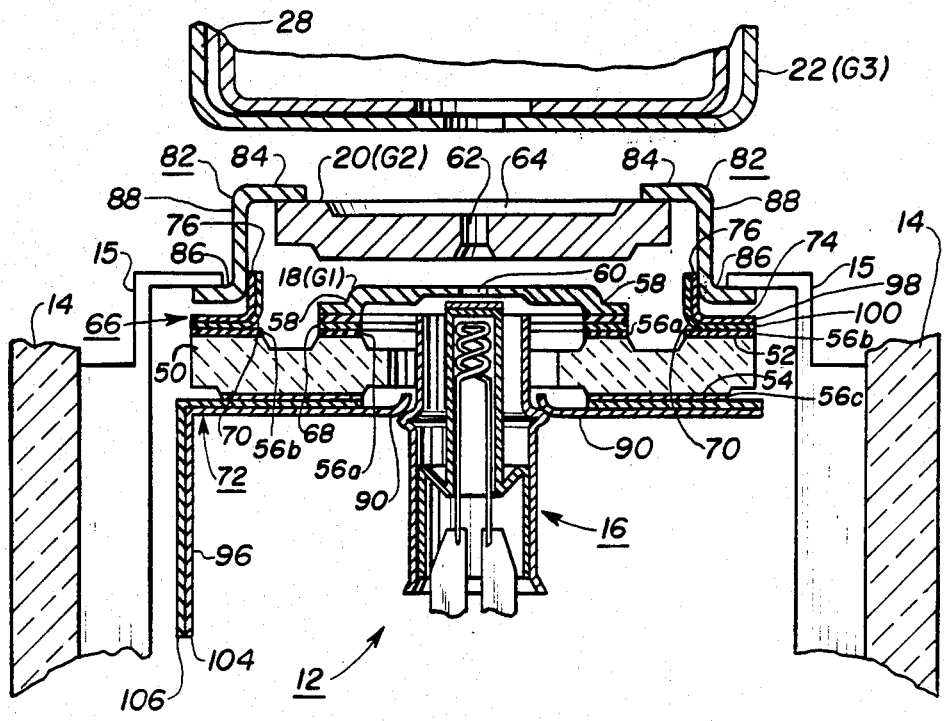
FIG. 2 is an enlarged sectional view of a beam-forming region (BFR) sub-assembly of the electron gun of FIG. 1.

The modular BFR subassembly 12, shown in FIG. 2, includes a common ceramic member 50, having an alumina content of about 99%, to which the cathode assemblies 16, the control grid 18 and the screen grid 20 are attached. The ceramic member 50 includes a first major surface 52 and an oppositely disposed substantially parallel second major surface 54. The ceramic member 50 has a thickness of about 1.5 mm (0.06 inch). At least a portion of the first major surface 52 has metallized patterns **56*a* and 56*b* formed thereon to permit attachment thereto of the electrodes 18 and 20, respectively. The metallized patterns 56*a* and 56*b* comprise discrete areas that are electrically isolated from each other. A plurality of electrically isolated metallized patterns 56*c* (only one of which is shown) are provided on the second major surface 54 to permit attachment of the cathode assemblies 16 thereto. The metallizing of a ceramic member is well known in the art and needs no further explanation. The major surfaces 52 and 54 may include lands, as shown in FIG. 2, which facilitate application of the electrically isolated metallized patterns thereto. The control grid electrode 18 is essentially a flat plate having two parallel flanges 58 on opposite sides of the three inline, precisely spaced, beam-defining apertures 60, only one of which is shown. The screen grid electrode 20 may comprise three separate plate-like portions each of which has a beam defining aperture 62 therethrough. Such a screen grid electrode is shown and described in the aforementioned patent application, Ser. No. 735,261. Alternatively, a single plate with three precisely located apertures may be used. The apertures in the control grid electrode and in the screen grid electrode are aligned for the passage of the electron beams. A recess 64 is formed in the surface of the screen grid electrode 20 that is adjacent to the lower first member 28 of the first focusing electrode 22. The recess 64** provides a horizontal convergence correction of the outer electron beams to compensate for charges in focus voltage. This structure is described in U.S. Pat. No. 4,520,292 issued to van Hekken et al. on May 28, 1985, and is incorporated by reference herein for the purpose of disclosure.

Figure 3:
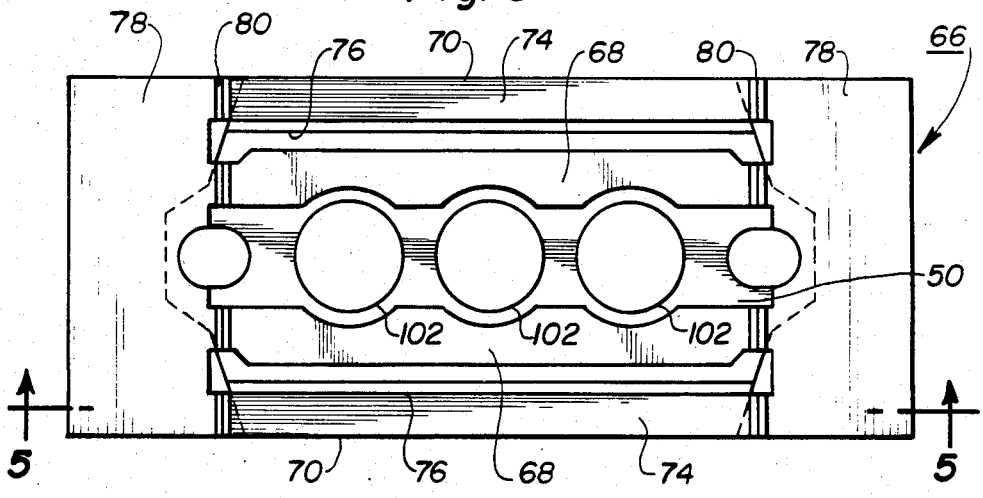
FIG. 3 is a plan view of a novel first transition member.

As shown in FIGS. 2 and 3, a novel first bimetal transition member 66 includes an electrode contact portion comprising a substantially flat first part 68 and a second part 70, having an L-shaped cross-section. The first transistion member 66 is brazed to metallized patterns **56*a* and 56*b* on first major surface 52 simultaneously with the brazing of a novel second bimetal transition member 72 to the metallized patterns 56*c* on the second major surface 54. The part 70 of the first transition member has a substantially flat first portion 74 in contact with the metallized pattern 56*b* and an upright portion 76 which is substantially perpendicular to the flat portion 74. The first transition member 66 and the second transition member 72 each have at least one novel removable frame portion as described hereinafter. As shown in FIG. 3, the first transition member 66 includes removable frame portions 78 which extend laterally beyond the first major surface of the common ceramic member 50 and which are connected to the electrical contact portion comprising the first and second parts 68 and 70 by V-notched weakened bridge regions 80. Removal of the frame portions 78 of the first transition member 66 at the weakened bridge regions 80 electrically isolates the first part 68 and the second part 70. As shown in FIG. 2, the second part 70 of the first transition member 66 extends along both sides of the first major surface 52 of the ceramic member 50 so that the screen grid electrode 20 can be disposed between the substantially parallel upright portions 76. The control grid electrode 18 is welded to the first part 68 of the first transition member 66. The height of the upright portions 76 of the first transition member is sufficient to permit longitudinal variations in the location of the screen grid electrode 20 to accommodate variations in the height of the control grid 18, or irregularities in the flatness of the ceramic member 50. In other words, neither the first major surface 52 of the ceramic member 50 nor the control grid electrode 18 is required to be a precision part since the plate-like screen grid electrode 20 can be longitudinally located by means of appropriate removable spacers (not shown), and laterally positioned to provide the desired spacing and alignment between the successive electrodes. At least two step-like support members 82 are secured to the screen grid electrode 20, one on each side. Each of the step-like support members 82 includes a screen grid electrode contact portion 84, a bead support contact portion 86 and a central riser portion 88 of precise length as described in copending U.S. patent application, Ser. No. 769,970 filed on Aug. 27, 1985 by S. T. Opresko. The Opresko patent application is assigned to the assignee of the present invention and is incorporated by reference herein for the purpose of disclosure. The screen grid electrode contact portions 84 are attached to the screen grid electrode 20. The central riser portions 88 are welded to the upright portions 76 of the first transition member 66 to secure the screen grid electrode 20 in alignment with and in spaced relation to the control grid electrode 18. The bead support contact portions 86 of the step-like support members 82 are welded to the bead support member 15 to secure the BFR subassembly 12 to the electron gun 10**.

Figure 4:
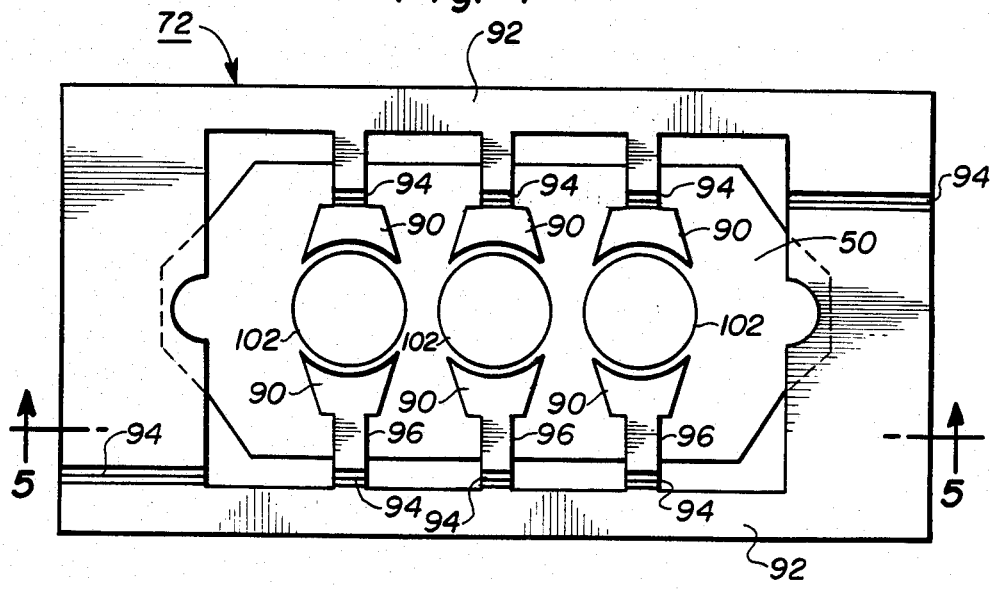
FIG. 4 is a plan view of a novel second transition member.

As shown in FIGS. 2 and 4, the novel second bimetal transition member 72 includes at least one and preferably three pairs of cathode assembly contact portions 90 and a pair of removable frame portions 92 which are connected to the cathode assembly contact portions 90 by V-notched weakened bridge regions 94 and which extend laterally beyond the second major surface of the common ceramic member 50. Removal of the frame portions 92 of the second transition member 72 at the weakened bridge regions 94 electrically isolates each of the cathode assembly contact portions 90. The bridge regions 94 are configured to provide integral cathode contact leads 96 on one side of the cathode assembly contact portions 90. Each of the cathode assemblies 16 are welded to a different pair of cathode assembly contact portions 90.

Figure 5:
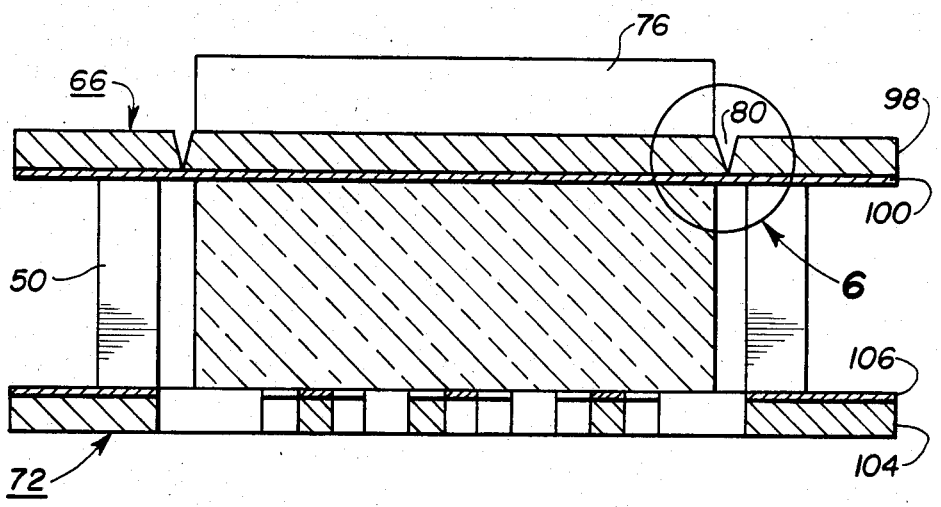
FIG. 5 is an enlarged side-sectional view of a portion of the BFR subassembly during its manufacture taken along lines 5—5 of FIGS. 3 and 4.
Figure 6:
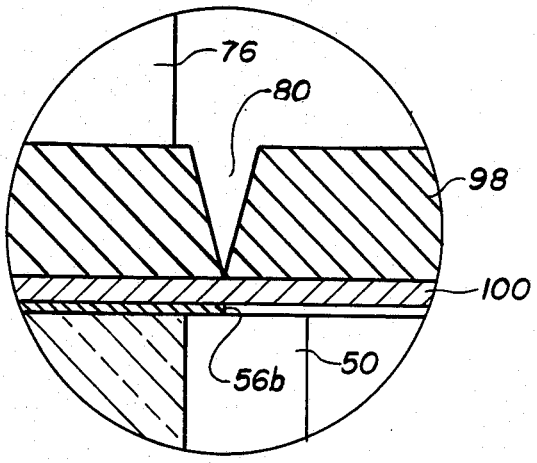
FIG. 6 is an enlarged view of a portion of the BFR subassembly shown within the circle 6 of FIG. 5.

With reference to FIGS. 2 and 3, the first bimetal transition member 66 is shown disposed on the first major surface 52 of the ceramic member 50. The transition member 66 includes two layers of metal bonded face-to-face to form a bimetal. A first metal layer 98 is preferably formed from a nickel-iron alloy of 42% nickel and 58% iron, having a thickness of about 0.2 mm (0.008 inches), which is not greater than about 20% of the thickness of the ceramic member 50. A second metal layer 100 is preferably formed of copper, having a thickness of about 0.025 mm (0.001 inches). The melting point of the copper layer 100 is about 1083° C., and the melting point of the nickel-iron alloy layer 98 is about 1427° C., which is substantially higher than that of the copper. The first transition member 66 is stamped or photo-etched and thereby configured to substantially conform to the shape of the metallized patterns **56*a* and 56*b* on the first major surface 52 of the ceramic 50. The second metal layer 100 is disposed on the first major surface 52. As shown in FIG. 3, the first electrode contact portion 68 is disposed above and below a trio of large inline apertures 102 formed in the common ceramic member 50. The second electrode contact portion 70 is transversely spaced from the first electrode contact portion 68. The removable frame portions 78 are connected to the electrode contract portions 68 and 70 by the weakened bridge regions 80 which comprise V-shaped notches provided in the first metal layer 98. As shown in FIGS. 5 and 6, the V-notched weakened bridge regions 80 extend through the first metal layer 98 and terminate at the interface with the second metal layer 100**.

The second bimetal transition member 72, shown in FIGS. 2, 4 and 5, also includes two layers of metal bonded face-to-face to form a bimetal. The first metal layer 104 is preferably formed of the above-described nickel-iron alloy and has a thickness of about 0.2 mm (0.008) inches), and the second metal layer 106 is preferably formed of copper and has a thickness of about 0.025 mm (0.001 inches). The second transition member 72 is stamped or photo-etched to conform to the shape of the metallized patterns **56*c* on the second major surface 54 of the ceramic member 50. During fabrication of the cathode-grid subassembly 16, the second metal layer 106, comprising copper, is disposed on the second major surface 54**.

Figure 7:
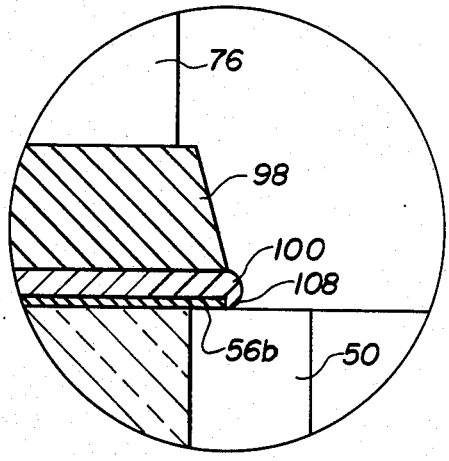
FIG. 7 is an enlarged view of the portion shown in FIG. 6 at a subsequent step in the manufacturing of the BFR subassembly.

The structure shown in FIG. 5 is assembled using a brazing jig of the type described in the above-referenced U.S. patent application Ser. No. 735,261. The brazing is preformed by heating the loaded jig in a wet hydrogen atmosphere in a BTU three-zone belt furnace (not shown) at temperatures of 1105° C., 1120° C., and 1105° C. to melt the copper layers 100 and 106. The belt speed through the furnace is four inches per hour. Since the first layers of metal 98 and 104 are V-notched through at the weakened bridge regions 80 and 94, respectively, the brazing operation melts the respective copper layers 100 and 106 causing the frame portions 78 and 92 to fall-away as the copper layers are brazed to the metallized patterns on the common ceramic member 50. As shown in FIG. 7, the exposed end 108 of copper layer 100 flows and contacts the edge of the metallized layer **56*b* forming a smooth end rather than the rough irregular edge produced by prior art break-away frames. Similarly, copper layer 106 forms smooth ends (not shown) where it contacts the edges of the metallized layer 56*c* at bridge regions 94**.

What is claimed is:

1. In a method of constructing an electron gun for a cathode-ray tube, said electron gun including at least one cathode assembly and at least two spaced, successive electrodes having aligned apertures therethrough for passage of at least one electron beam, said electrodes being held in position from a common ceramic member having a first major surface and an oppositely disposed second major surface with a metallized pattern formed on at least a portion of each major surface, a bimetal first transition member being disposed between at least one of said electrodes and said first major surface of said common ceramic member, said bimetal first transition member comprising two layers of metal bonded face-to-face along an interface extending therebetween, a first layer of metal having a melting point higher than that of a second layer of metal, said second layer being brazed to said metallized pattern on said first major surface, said bimetal first transition member including at least one electrode contact portion and a removable frame portion, the improvement comprising providing a V-notched weakened bridge region interconnecting said frame portion and said electrode contact portion of said first transition member, said V-notched bridge region extending through said first layer of metal and terminating at the interface with said second layer of metal, removing said frame portion from said electrode contact portion at said V-notched bridge region by melting said second layer of metal when said second layer is brazed to said metallized pattern on said first major surface of said common ceramic member, thereby providing a substantially smooth edge on said contact portion when said frame portion is removed.

2. An electron gun constructed in accordance with the method of claim 1.

* * * * *